US006036551A

United States Patent [19]

Szczesny

[11] Patent Number: 6,036,551

[45] Date of Patent: Mar. 14, 2000

[54] STACKABLE ELECTRICAL CONNECTOR

[75] Inventor: David S. Szczesny, Palmyra, Pa.

[73] Assignee: The Whitaker Corporation, Wilmington, Del.

[21] Appl. No.: 09/187,798

[22] Filed: Nov. 6, 1998

[51] Int. Cl.[7] ..... H01R 13/514

[52] U.S. Cl. ..... 439/701

[58] Field of Search ..... 439/701, 660, 439/377, 64, 59, 260, 325, 327, 541.5

[56] References Cited

U.S. PATENT DOCUMENTS

| | | | |
|---|---|---|---|
| 3,246,279 | 4/1966 | Storcel | 339/17 |
| 4,017,770 | 4/1977 | Valfre | 361/399 |
| 4,695,116 | 9/1987 | Bailey et al. | 439/188 |
| 4,696,525 | 9/1987 | Coller et al. | 439/69 |
| 4,810,203 | 3/1989 | Komatsu | 439/326 |
| 4,818,239 | 4/1989 | Erk | 439/55 |
| 4,872,843 | 10/1989 | Anstey | 439/69 |
| 4,878,856 | 11/1989 | Maxwell | 439/540 |
| 4,941,841 | 7/1990 | Darden et al. | 439/377 |
| 5,037,330 | 8/1991 | Fulponi et al. | 439/607 |
| 5,044,984 | 9/1991 | Mosser et al. | 439/540 |
| 5,176,523 | 1/1993 | Lai | 439/64 |

*Primary Examiner*—Renee S. Luebke
*Assistant Examiner*—Eugene G. Byrd
*Attorney, Agent, or Firm*—Robert Kapalka

[57] ABSTRACT

An electrical connector includes a housing having a base and first and second parallel walls which are connected to the base. The first and second walls are spaced-apart to define a slot therebetween. The first wall has a thickness and an open portion which exposes the slot through the thickness of the first wall. The second wall has a thickness and an apertured portion which exposes the slot through the thickness of the second wall. The open portion is complementary to non-apertured portions of the second wall, and the apertured portion is complementary to non-open portions of the first wall. Multiple electrical connectors can be stacked by nesting the non-apertured portions of each connector in the open portion an adjacent connector, and nesting the non-open portions of each connector in the apertured portion of another adjacent connector.

11 Claims, 4 Drawing Sheets

STACKABLE ELECTRICAL CONNECTOR

FIELD OF THE INVENTION

The invention relates to an electrical connector which is adapted to be stacked in an array of similar connectors.

BACKGROUND OF THE INVENTION

Memory cards are known for use with computers to enhance computer operational capabilities. Individual memory cards are installed in memory card connectors which are mounted on a computer motherboard. Each memory card connector has a card-receiving slot between two spaced-apart walls. In order to accommodate go multiple memory cards simultaneously, multiple memory card connectors may be provided on the motherboard. Also, due to the need to conserve space within a computer, multiple memory card connectors may be mounted adjacent to each other in stacked relationship.

U.S. Pat. No. 5,176,523 discloses a stackable memory card connector having a single wall and an open bottom which serves to reduce the stacked height of multiple memory card connectors. A first of these connectors can be mounted on a circuit board with the open bottom facing the circuit board so that the circuit board closes off the open bottom and serves as one wall of the memory card slot. Successive connectors are stackable on the first connector with the open bottom of each successive connector facing the wall of each preceding connector so that the wall of each preceding connector serves as a wall of the slot for the next higher connector in the stack. This memory card connector has the drawback that it can only be mounted parallel to the circuit board because the circuit board forms a slot wall for the first connector in the stack.

There is a need for a memory card connector which can be mounted perpendicular to a circuit board and which is suitable for being stacked in an array of similar connectors with a low stack height.

SUMMARY OF THE INVENTION

The invention is an electrical connector comprising a housing including a base and first and second parallel walls which are connected to the base. The first and second walls are spaced-apart to define a slot therebetween. The first wall has a thickness and an open portion which exposes the slot through the thickness of the first wall. The second wall has a thickness and an apertured portion which exposes the slot through the thickness of the second wall. The open portion is complementary to non-apertured portions of the second wall, and the apertured portion is complementary to non-open portions of the first wall. The electrical connector can be stacked in an array of similar connectors by nesting the non-apertured portions of the electrical connector in the open portion of an adjacent similar connector, and by nesting the non-open portions of the electrical connector in the apertured portion of another adjacent connector.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
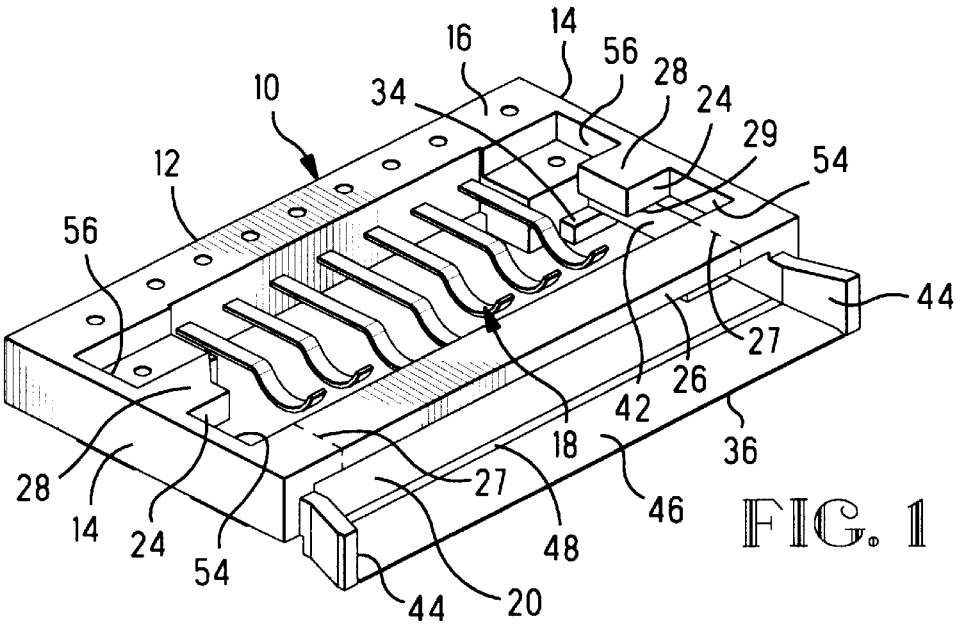
FIG. 1 is a top isometric view of an electrical connector according to the invention.
Figure 2:
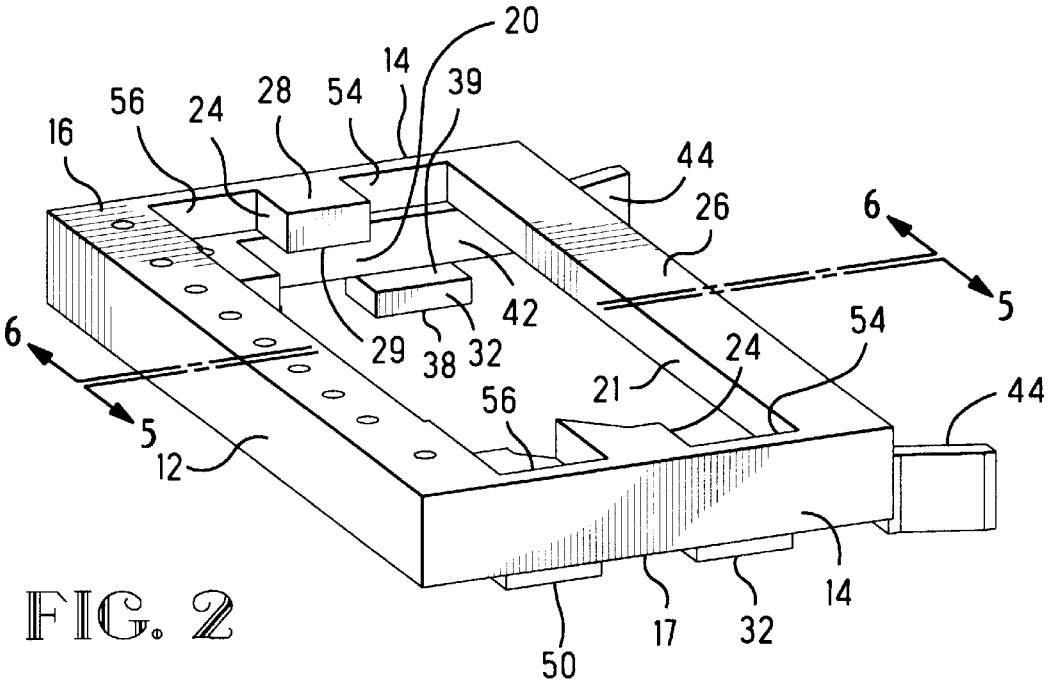
FIG. 2 is a top isometric view of the connector from a different perspective, with terminals having been removed from the connector for clarity.
Figure 3:
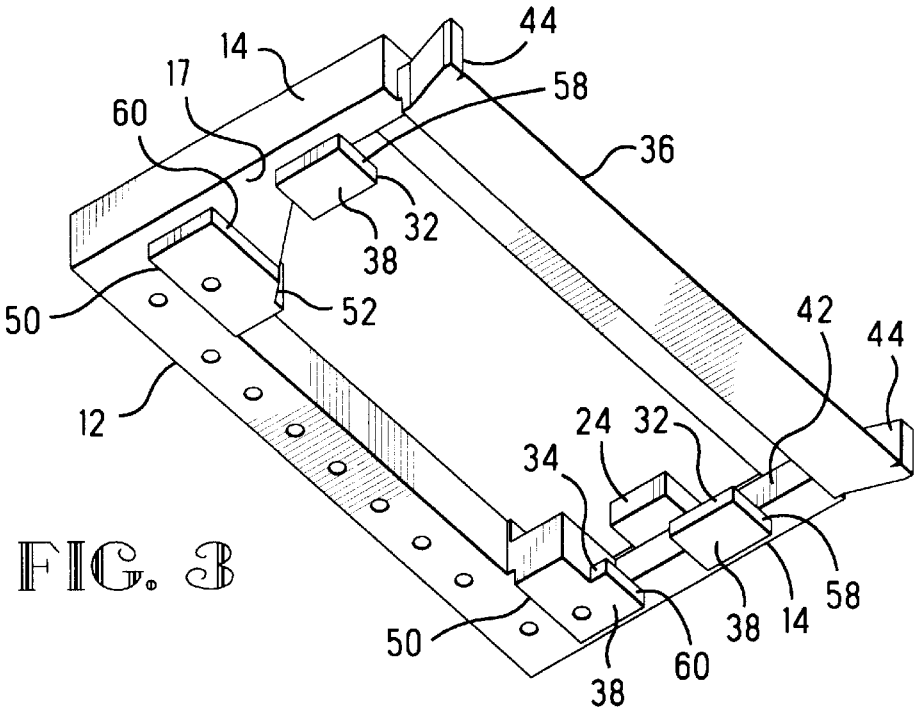
FIG. 3 is a bottom isometric view of the connector without terminals.
Figure 4:
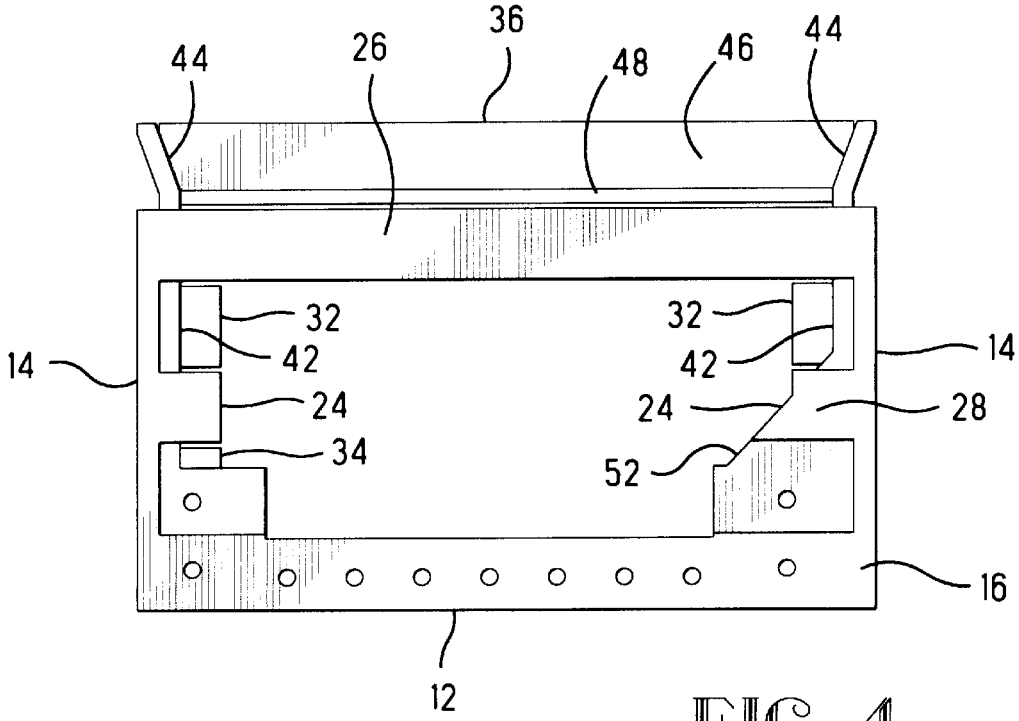
FIG. 4 is a top plan view of the connector without terminals.
Figure 5:
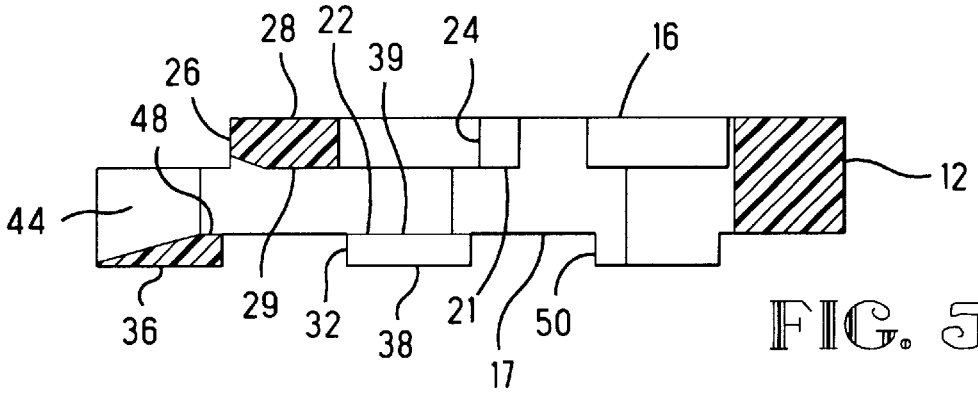
FIG. 5 is a cross-sectional view taken along line 5—5 of FIG. 2.
Figure 6:
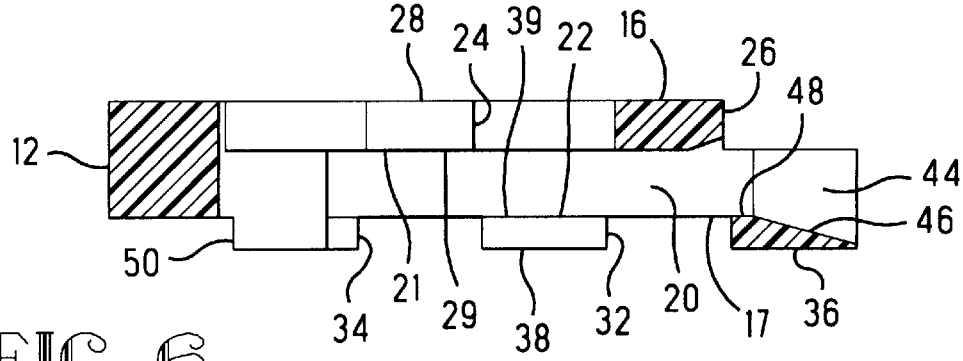
FIG. 6 is a cross-sectional view taken along line 6—6 of FIG. 2.

There is shown in FIGS. 1–6 an electrical connector according to the invention comprising a dielectric housing 10 including a base 12 and pair of beams 14 extending upwardly from opposite ends of the base. The base 12 and the beams 14 form a frame having opposite side surfaces 16, 17 which reside in respective planes. In a preferred embodiment the side surfaces are parallel to each other. The base holds a plurality of terminals 18 (FIG. 1) which are configured for electrical connection with conductive pads on a memory card (not shown) which can be received in the connector.

The housing also includes a pair of walls which are connected to the beams 14. A first or main wall 21 is defined by a pair of first ledges 24 and a crossbeam 26 that interconnects the beams 14. A second wall 22 is defined by a pair of second ledges 32 and a corner ledge 34. The first and second walls extend parallel to each other and are spaced-apart to define a slot 20 therebetween. The slot 20 is configured to receive a memory card. The housing also includes a crossbeam 36 which is disposed at an entrance to the slot. Ends of the slot are defined by guide surfaces 42 on the beams 14. The first and second walls 21, 22 and the guide surfaces 42 define boundaries of the slot and serve to contain the memory card in the slot.

It is a notable feature of the invention that the first and second walls 21, 22 do not have the form of whole plates extending between the beams 14. Instead, each of the walls 21, 22 has a relatively large open area which exposes the slot 20 through the walls, as will be more fully discussed below.

The first wall 21, which is defined by the first ledges 24 and the crossbeam 26, has an outer face 28 and an inner face 29. The outer face 28 resides in a plane which coincides with the plane of the side surface 16 of the housing. The first wall 21 is disposed on an interior side of the plane defined by the side surface 16. The inner face 29 defines one side of the slot 20.

It should be understood that the first wall 21 could be formed in an alternate embodiment by omitting a center portion of the crossbeam 26 such as between phantom ends 27 (FIG. 1) so as to leave two ledges connected to the rails 14. These ledges would still have the inner face 29 which defines one side of the slot 20.

The second wall 22, which is defined by the second ledges 32 and the corner ledge 34, has an outer face 38 and an inner face 39. The inner face 39 resides in a plane which coincides with the plane of the side surface 17. The second wall 22 is disposed on an exterior side of the plane defined by the side surface 17. The inner face 39 defines an opposite side of the slot 20 from the side defined by the inner face 29. The second wall 22 has a thickness between the outer and inner faces 38, 39 which may be the same as, or somewhat less than, a thickness of the first wall 21 between the outer face 29 and the inner face 28.

The crossbeam 36 is connected to entrance guides 44 which are connected to the rails 14. The crossbeam 36 is relatively further from the base 12 than the crossbeam 26. Therefore, the crossbeams are not directly opposed to each other. Instead, the crossbeams are offset from each other at the entrance to the slot 20. The crossbeam 36 preferably has a ramp surface 46 which is inclined with respect to the plane of the inner face 39, and a support surface 48 which resides in the plane of the inner face 39. In this case, the inner face 39 includes the support surface 48. The guides 44 are angled with respect to the guide surfaces 42. The guides 44 and the ramp surface 46 serve to guide a memory card into the slot between the inner faces 29, 39.

The housing also includes pedestals 50 which extend on an exterior side of the plane defined by the side surface 17. These pedestals have an outer surface which is in the same plane as the outer surface 38 of the ledges 32 and 34. The corner ledge 34 is connected to one of the pedestals 50. The other pedestal 50 has an angled surface 52 at an inner end of the slot 20. This angled surface 52 is complementary to an angled edge on one corner of the memory card (not shown), thereby preventing the memory card from being fully inserted into the slot unless the memory card has the proper orientation.

The first wall 21 has an open portion which extends through the thickness of the first wall, thereby leaving non-open portions including the first ledges 24 and the crossbeam 26. The open portion may be formed as one large open area or as a number of relatively smaller open areas. The open portion is configured complementary to the ledges 32 and 34 of the wall 22. In particular, the open portion includes pockets 54 that can receive the second ledges 32 of an adjacent similar connector, and pockets 56 that can receive the pedestals 50 and the corner ledge 34 of the adjacent similar connector.

The second wall 22 has an apertured portion which extends through the thickness of the second wall, thereby leaving non-apertured portions including the ledges 32 and 34. Similar to the open portion of the first wall, the apertured portion may be formed as one large area or as a number of relatively smaller areas. The apertured portion is configured complementary to the first ledges 24 and the crossbeam 26 of the first wall 21. In particular, the apertured portion includes reliefs 58 that can receive the crossbeam 26 of an adjacent similar connector, and reliefs 60 that can receive the first ledges 24 of the adjacent similar connector.

Figure 7:
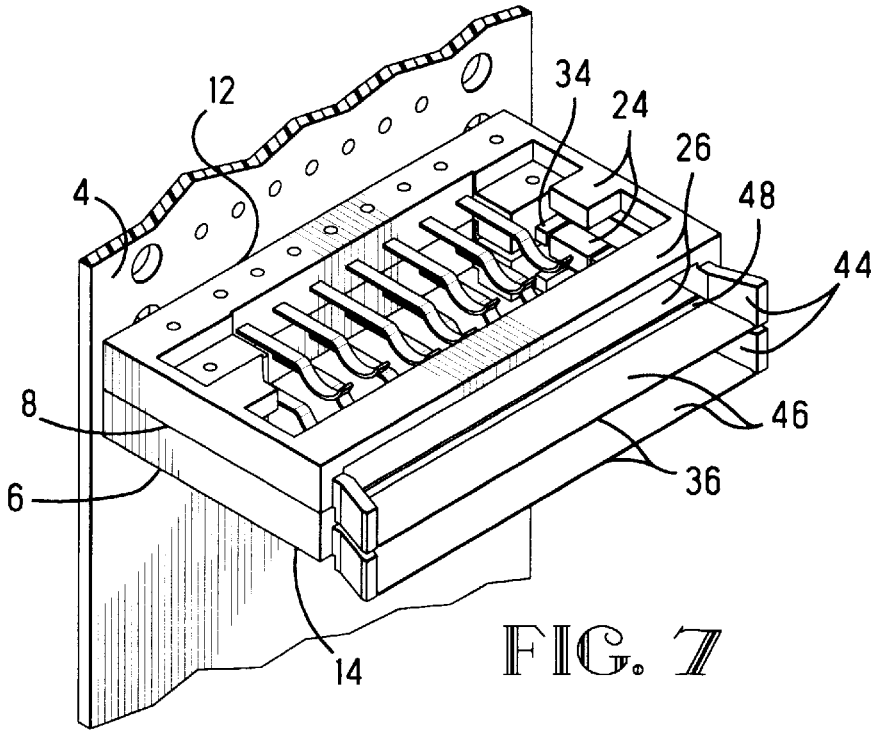
FIG. 7 is a top isometric view of two connectors according to the invention in stacked relationship.
Figure 8:
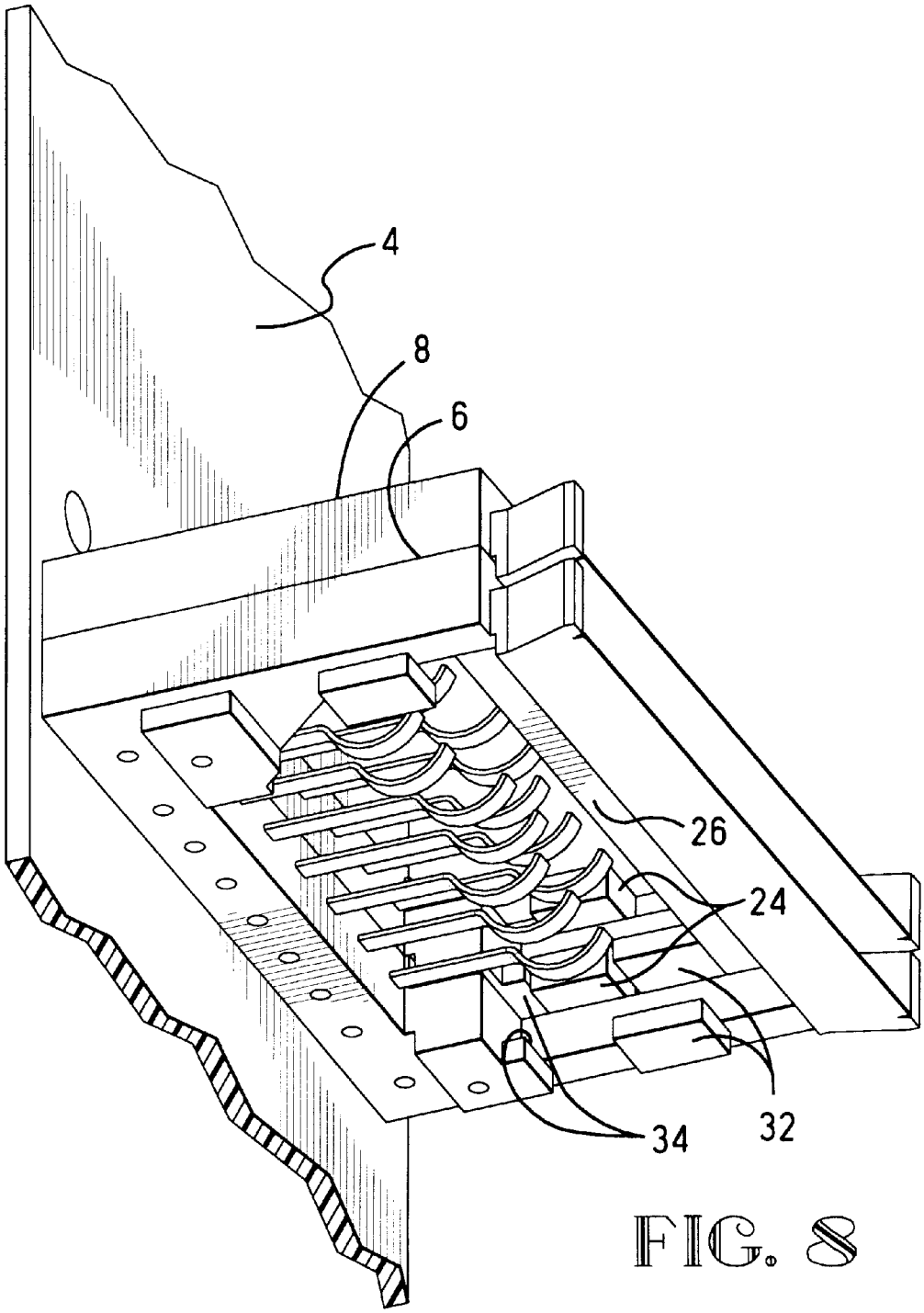
FIG. 8 is a bottom isometric view of the connectors in stacked relationship.

As shown in FIGS. 7–8, two connectors 6, 8 according to the invention can be stacked together. The connectors 6, 8 will be discussed with reference to the same terms and reference numbers as previously used in the discussion of FIGS. 1–6. The connectors are mounted on a circuit board 4 with the base 12 of each connector adjacent to the circuit board and the beams 14 extending perpendicular to the circuit board. The connectors are stacked with the side surface 17 of the connector 8 being engaged with the side surface 16 of the connector 6. The crossbeam 26 of the connector 6 is disposed in the apertured portion including the reliefs 58 of the connector 8, and the first ledges 24 of the connector 6 are disposed in the reliefs 60 of the connector 8. Also, the second ledges 32 of the connector 8 are disposed in the open portion including the pockets 54 of the connector 6, and the pedestals 50 and the corner ledge 34 of the connector 8 are disposed in the pockets 56 of the connector 6. In this way, the second wall 22 of the connector 8 is nested within the wall 21 of the connector 6, and vice versa. Thus, the total thickness of two stacked connectors according to the invention will be reduced by the thickness of one of the walls 21, 22, as compared to a stack of two non-nested connectors. Obviously, any number of similar connectors according to the invention can be stacked together with a wall of each succeeding connector being nested within a wall of each preceding connector, thereby accumulating the benefits of reduced stack height for the overall stacked array.

It should be noted that when the connectors are in stacked relationship, the outer face 28 of the first wall of the connector 6 is co-planar with the inner face 39 of the second wall of the connector 8. Similarly, when a third connector is stacked on the connector 8, the outer face 38 of the second wall of the third connector will be co-planar with the inner face 29 of the first wall of the connector 8. Thus, stacking the connectors serves to form continuous sides for the slot 20 in each of the connectors due to wall portions of adjacent connectors being received in the pockets 54, 56 and the reliefs 58, 60 of each connector.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical connector comprising:

a housing including a base and first and second parallel walls which are connected to the base, the first and second walls being spaced-apart to define a slot therebetween;

the first wall having a thickness and an open portion which exposes the slot through the thickness of the first wall;

the second wall having a thickness and an apertured portion which exposes the slot through the thickness of the second wall;

the open portion being complementary to non-apertured portions of the second wall, and the apertured portion being complementary to non-open portions of the first wall;

wherein the electrical connector can be stacked with an adjacent similar connector by nesting the non-apertured portions of one said connector in the open portion of the other said connector.

2. The electrical connector of claim 1 wherein the housing includes a pair of beams extending from opposite ends of the base, the beams have opposite side surfaces which reside in respective planes, the first wall is disposed on an interior side of one of the planes, and the second wall is disposed on an exterior side of the other of the planes.

3. The electrical connector of claim 2 wherein the first wall includes a crossbeam which interconnects the pair of beams.

4. The electrical connector of claim 2 wherein the first wall includes a pair of first ledges each connected to a respective one of the pair of beams.

5. The electrical connector of claim 4 wherein the second wall includes a pair of second ledges each connected to a respective one of the pair of beams.

6. The electrical connector of claim 3 wherein the second wall includes a crossbeam which interconnects the pair of beams, and the crossbeam of the second wall is offset from the crossbeam of the first wall.

7. An electrical connector comprising:

a housing including base and a pair of beams extending from the base, first and second ledges extending from each of the beams, each of the first and second ledges having an outer surface and an inner surface, the inner surfaces of the first ledges residing in a first plane and the inner surfaces of the second ledges residing in a second plane that is spaced-apart from the first plane, thereby defining a slot between the first ledges and the second ledges, and the first ledges being offset from the second ledges, wherein the electrical connector can be stacked with an adjacent similar connector by interleaving the first ledges of the electrical connector with the second ledges of the adjacent similar connector.

8. The electrical connector of claim 7 wherein a first crossbeam interconnects the pair of beams.

9. The electrical connector of claim 8 wherein the first crossbeam has an inner surface which is disposed in the first plane.

10. The electrical connector of claim 8 wherein a second crossbeam interconnects the pair of beams, and the second crossbeam is offset from the first crossbeam.

11. The electrical connector of claim 10 wherein the second crossbeam has an inner surface which is disposed in the second plane.

* * * * *